US005359940A

United States Patent [19]

Van Lierde

[11] Patent Number: 5,359,940

[45] Date of Patent: Nov. 1, 1994

[54] METHOD AND DEVICE FOR THE DECOUPLING/COUPLING OF TRANSPORT ELEMENTS TO A DRIVE MECHANISM

[75] Inventor: Carlos-Gustaaf-Arthur Van Lierde, Zomerstraat,

[73] Assignee: Elektriciteit Voor Goederenbehandeling Marine En Industrie in het verkort Egemin, naamloze vennootschap, Schoten,

[21] Appl. No.: 77,649

[22] Filed: Jun. 17, 1993

[30] Foreign Application Priority Data

Jun. 18, 1992 [BE] Belgium ..... 09200570

[51] Int. Cl.[5] ..... B61B 10/00

[52] U.S. Cl. ..... 104/172.3

[58] Field of Search ..... 104/172.1, 172.2, 172.3, 104/170

[56] References Cited

U.S. PATENT DOCUMENTS

| | | | |
|---|---|---|---|
| 3,027,850 | 4/1962 | Burrows | 104/172.2 |
| 3,425,361 | 2/1969 | Bishop | 104/172.2 |
| 3,648,618 | 3/1972 | Pierson et al. | 104/170 |
| 4,020,768 | 5/1977 | Newbegin | 104/172 BT |
| 4,203,370 | 5/1980 | Sapila | 104/172.2 |

FOREIGN PATENT DOCUMENTS

| | | | |
|---|---|---|---|
| 0059478 | 5/1977 | Japan | 104/172.2 |

*Primary Examiner*—Mark T. Le
*Attorney, Agent, or Firm*—Foley & Lardner

[57] ABSTRACT

Method for decoupling and/or coupling of transport elements to a drive mechanism, in particular a drive mechanism (2) with a mainly continuously moving drive element (3). The decoupling and/or coupling is done by the coupling element (4) provided onto the transport element (1) which can work in conjunction with the drive mechanism (2). The speed of the coupling element (4) is gradually reduced prior to the decoupling, and gradually increased after the coupling respectively.

14 Claims, 8 Drawing Sheets

METHOD AND DEVICE FOR THE DECOUPLING/COUPLING OF TRANSPORT ELEMENTS TO A DRIVE MECHANISM

BACKGROUND OF THE INVENTION

The present invention concerns a method and device for the decoupling and/or coupling and/or keeping coupled of transport elements to a drive mechanism.

In particular the invention concerns a method for the decoupling and/or coupling and/or keeping coupled of transport elements to a drive mechanism which has a mainly continuously moving drive element, such as an endless chain, whereby the decoupling and/or coupling and/or keeping coupled is done by means of a coupling element provided onto the transport element which acts onto the drive element.

The invention mainly aims at distribution systems to automatically distribute goods and such in work rooms, such as shop floors, whereby the transport elements consist of trolleys which are loaded in specific places, which are subsequently coupled to the drive element and are detached at the place of destination of the drive element.

In the known devices, the trolleys are coupled to the chain by means of a pin. Since the chain moves at a constant speed, this is disadvantageous in that it is rather difficult to decouple a trolley and in that the trolley jolts away as it is coupled, whereby both the coupling pin and the chain are heavily loaded.

SUMMARY OF THE INVENTION

The present invention concerns a method and device according to which the above-mentioned disadvantages are excluded.

To this end the invention in the first place concerns a method for the decoupling and/or coupling and/or keeping coupled of transport elements to a drive mechanism, in particular to a drive mechanism with a continuously moving drive element, whereby the decoupling and/or coupling and/or keeping coupled is done by means of a coupling element provided onto the transport element which can work in conjunction with the drive mechanism, characterized in that the speed of the coupling element is gradually reduced prior to the decoupling, gradually increased after the coupling respectively.

According to a preferred embodiment the coupling element is led prior to the decoupling and/or after the coupling along a trajectory different from the trajectory of the above-mentioned drive element, whereby the first trajectory makes it possible for the speed of the coupling element to be gradually reduced prior to the decoupling, and to be gradually increased after the coupling.

The invention also concerns a device for the decoupling and/or coupling and/or keeping coupled of transport elements to a drive mechanism, in particular to a drive mechanism with a mainly continuously moving drive element, whereby the decoupling and/or coupling and/or keeping coupled is done by means of a coupling element provided onto the transport element which can work in conjunction with the drive mechanism, characterized in that it has means which make it possible to gradually reduce the speed of the coupling element prior to the decoupling, and to gradually increase it after the coupling respectively.

According to a preferred embodiment, the above-mentioned device is characterized in that the above-mentioned means at least make it possible to decouple the coupling element from the drive mechanism and in that they consist to this end of a rotating guiding element which exerts a carrier force onto the coupling element on the one hand, and a guide for the coupling element on the other hand, such that this coupling element moves along the guiding element according to a trajectory whereby the distance from the coupling element to the point of rotation of the above-mentioned guiding element is reduced as a result of which the speed is slowed down until a point where the coupling element is decoupled.

Analogously, the above-mentioned means, in order to couple the coupling element to the drive mechanism, may consist of a rotating guiding element which exerts a carrier force onto the coupling element, and of a guide for the coupling element, such that this coupling element moves along the guiding element according to a trajectory whereby the distance of the coupling element to the point of rotation of the above-mentioned guiding element is increased as a result of which the speed is increased until the point where the coupling element acts onto the transport element.

BRIEF DESCRIPTION OF THE DRAWINGS

In order to better explain the characteristics according to the invention, by way of example only and without being limitative in any way, the following preferred embodiment is described with reference to the accompanying drawings, in which:

FIG. 8 is drawn to a larger scale;

DETAILED DESCRIPTION OF THE PREFERRED EMBODIMENT

Figure 1:
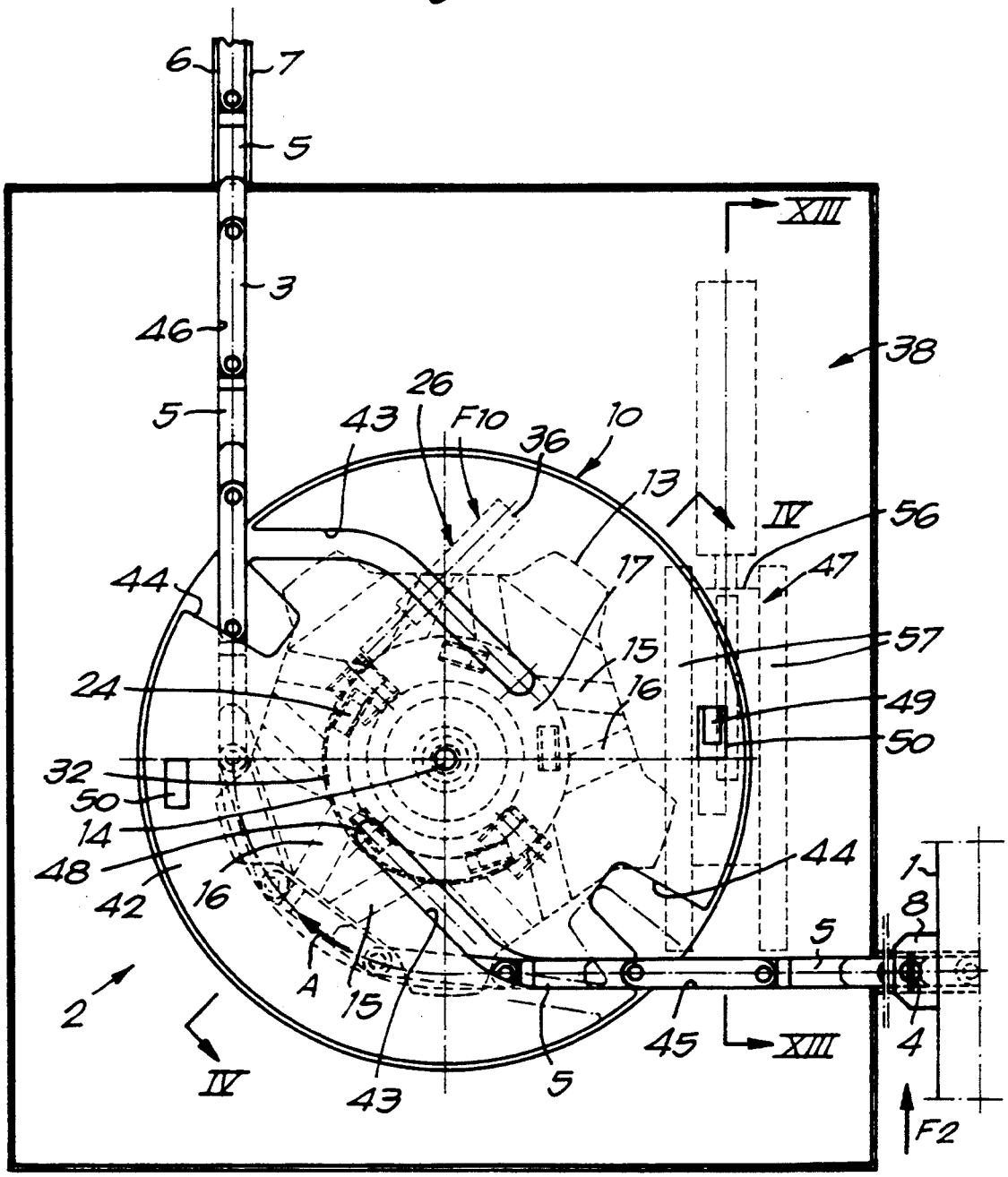
FIG. 1 shows a top view of a device according to the invention.

As shown in FIG. 1, the invention concerns a device for the decoupling and/or coupling and/or the keeping coupled of a transport element 1, such as a trolley, to a guidance system 2, in particular to a guidance system 2 with a mainly continuously moving drive element 3, for example a chain. The drive element 3 is hereby guided according to a specific trajectory A, via the required guiding means, and is hereby driven with a constant speed by means of a drive not represented in the figures.

Figure 2:
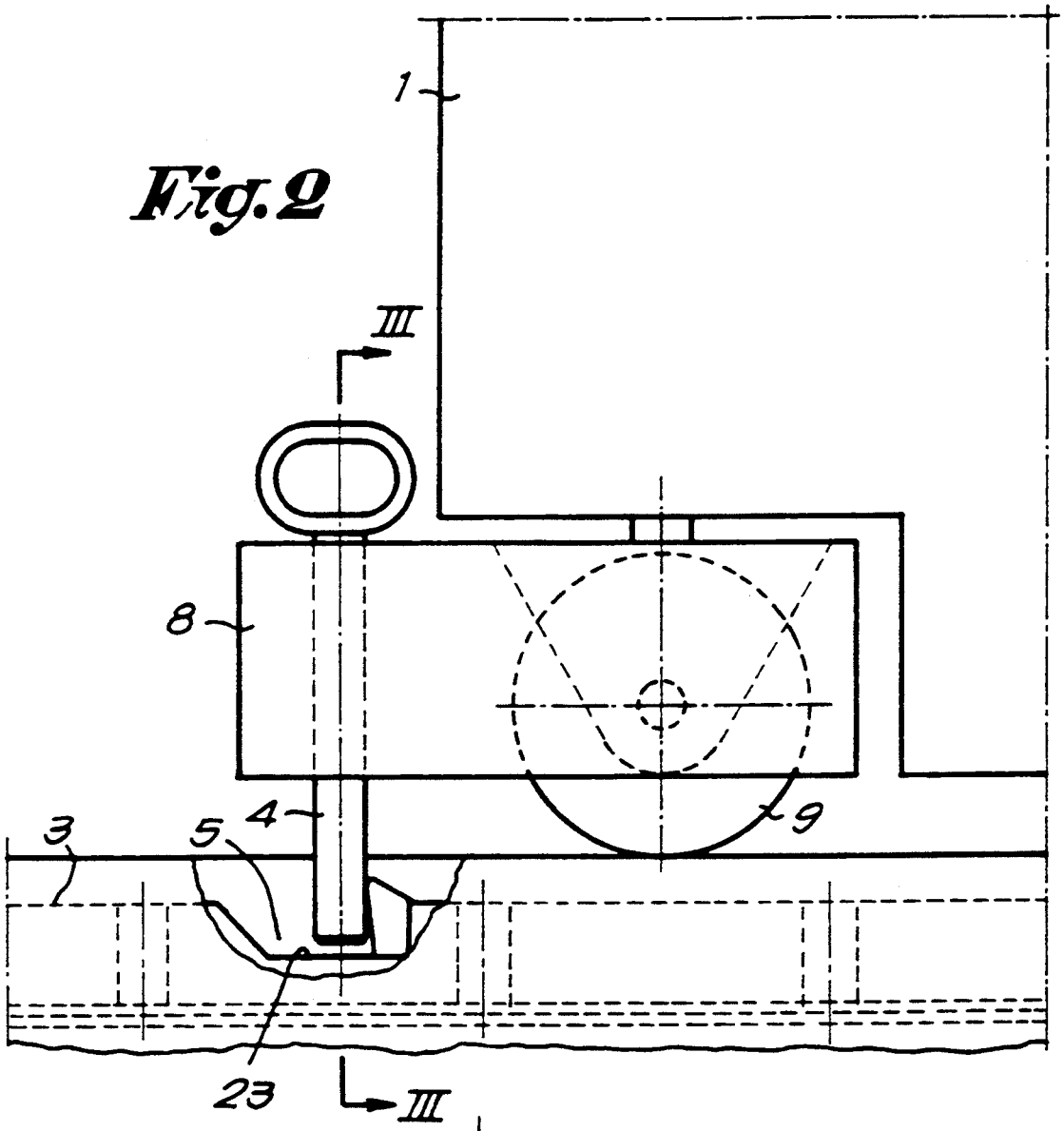
FIG. 2 shows a view to a larger scale according to arrow F2 in FIG. 1.
Figure 3:
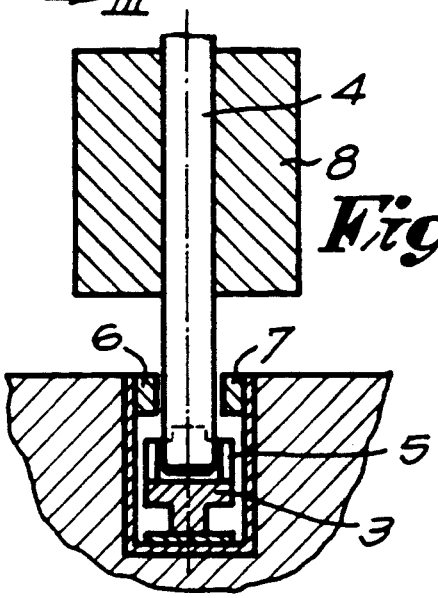
FIG. 3 shows a section according to line III—III in FIG. 2.

The coupling between the transport element 1 and the guidance system 2 is done by means of a coupling element 4, such as a pin, which as represented in FIGS. 2 and 3, is attached to the transport element 1, and which works in conjunction with the drive element 3, for example by acting onto a recess 5 provided herein. A handle may be provided on the coupling element. The drive element 3 is guided in its normal trajectory between profiles 6 and 7 or the like, in such a manner that the coupling element 4 is prevented from sliding out of the recess 5 sideways.

As shown in FIG. 2, the coupling element 4 may be fixed in a hinged frame work 8 in which the front wheels 9 of the transport element 1 are mounted. The coupling element 4 may also be directly fixed onto the transport element 1, whereby the front wheels are made as swivel castors.

The device according to the invention is special in that it has means 10 which make it possible to gradually reduce the speed of the coupling element 4 prior to the decoupling, and to gradually increase it until it reaches the speed of the drive element 3 after the coupling respectively.

Figure 4:
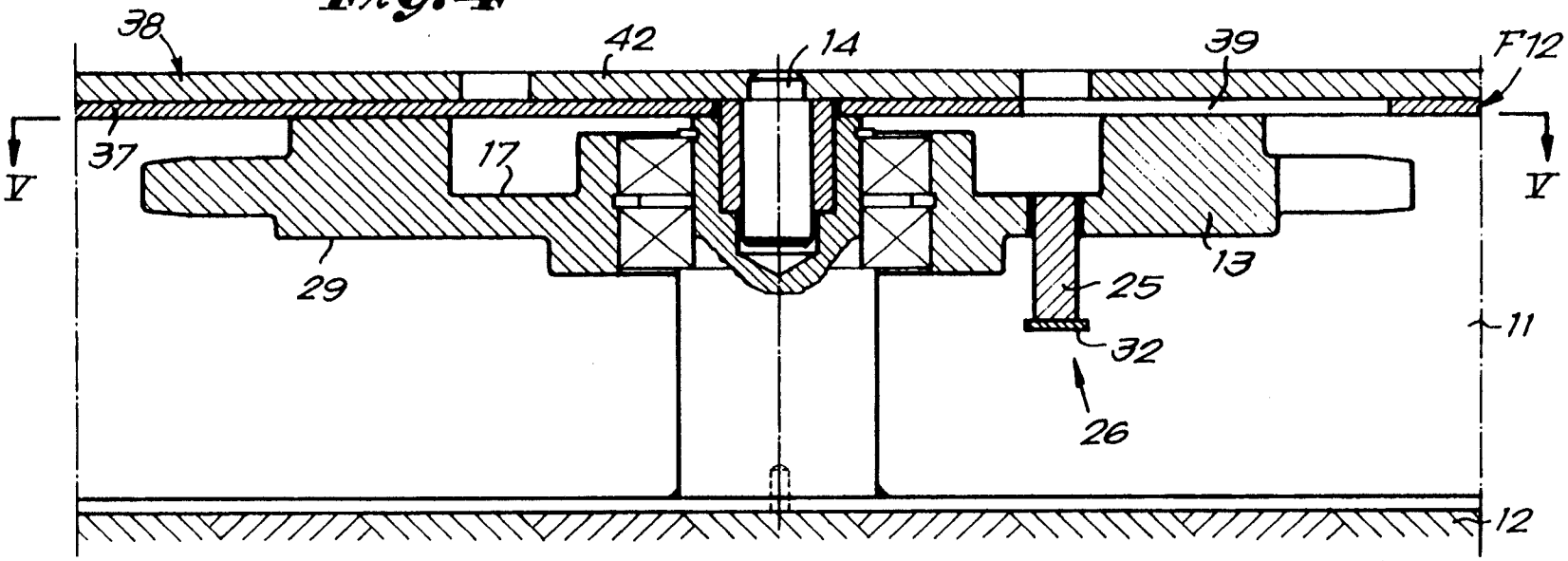
FIG. 4 shows a section to a larger scale according to line IV—IV in FIG. 1.

As shown in FIGS. 1 and 4, the device to this aim has a recess 11 in the bottom 12 in which a rotating guiding element 13 is provided which, as will be explained below, is meant to exert a carrier force on the coupling element 4. This guiding element 13 consists in the embodiment shown of a gear wheel which can rotate around a shaft 14 and which acts onto the drive element 3 on the one hand and is thus driven by the movement of the latter, and which also provides for the guidance of the drive element 3 on the other hand.

According to a particular embodiment, the rotating guiding element 13 may be driven.

Figure 5:
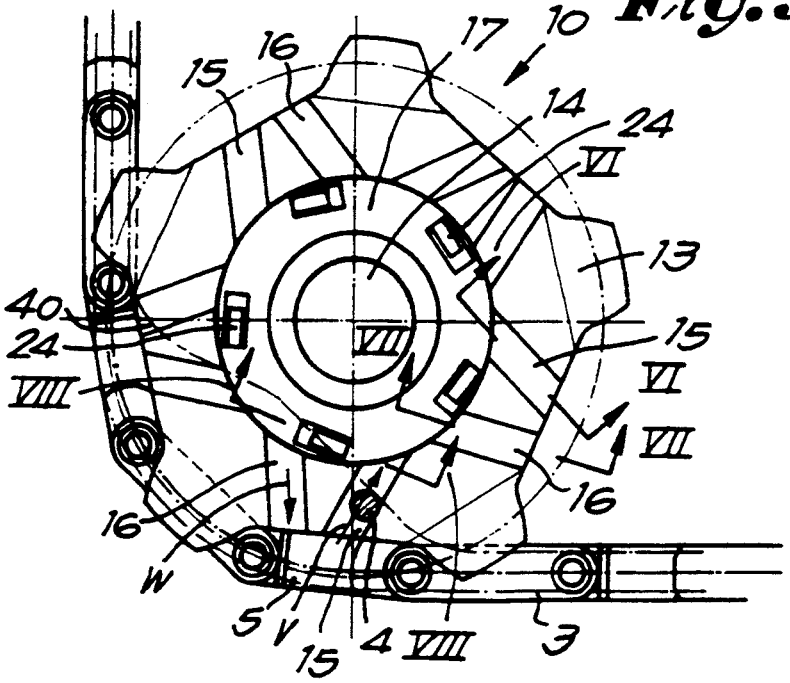
FIG. 5 shows a section according to line V—V in FIG. 4.
Figure 6:
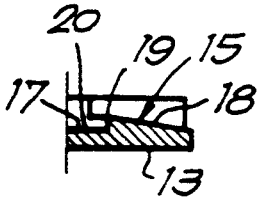
FIGS. 6, 7 and 8 show sections according to lines VI—VI, VII—VII and VIII—VIII in FIG. 5, whereby

As shown in FIG. 5, the guiding element 13 is provided with several pairs of guides 15 and 16, consisting of slots in the top side of said element 13. The guides 15 and 16 mainly extend radially, which should also be understood as "oblique with regard to the radial direction". The guide 15 hereby makes it possible for the coupling element 4 to move along a direction V from the outer diameter of the guiding element 13 to the concentric, ring-shaped recess or slot 17. As shown in FIG. 6, the guide 15 preferably has a slanting bottom 18 which tapers radially upward towards the inside, such that the inner edge 19 thereof is situated higher than the bottom 20 of the guide 17.

Figure 7:
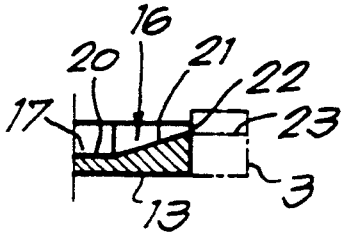

The guide 16 makes it possible to move the coupling element 4 back to the drive element 3 from the recess 17 according to a direction W. As shown in FIG. 7, the guide 16 preferably has a slanting bottom 21, which tapers radially upward however towards the outside, such that the outer edge 22 thereof is situated higher than the bottom 23 of the above-mentioned recesses 5.

As shown in FIG. 5, the recess 17 is provided with different cooperating stops 24, which can be brought inside or outside said recess 17 and which are situated exactly next to the extension of the guides 16.

Preferably, these stops 24, of which the aim will be explained further in the description, consist of countersinking elements 25 in the bottom 20 of the recess 17 which can be lifted up from the bottom 20 by means of a control element 26 schematically represented in FIG. 1.

Figure 8:
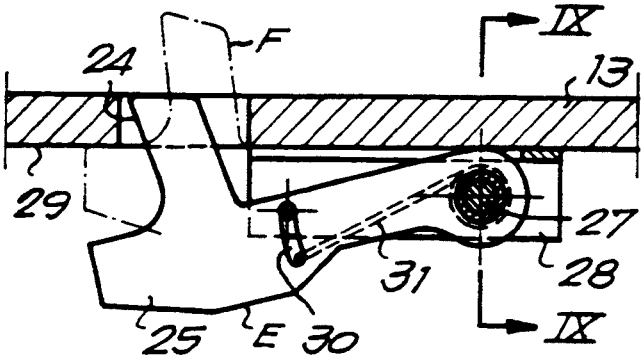
Figure 9:
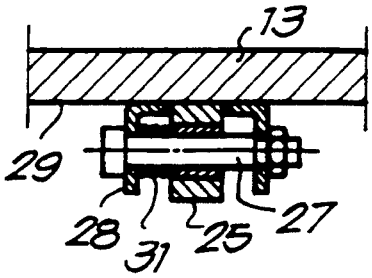
FIG. 9 shows a section according to line IX—IX in FIG. 8.

The shape and fixing of the elements 25 is represented in greater detail in FIGS. 8 and 9. Each element 25 can hereby rotate around a shaft 27 which is mounted in a frame 28 which is fixed to the bottom side 29 of the rotating guiding element 13 or forms a whole with it. In rest position, the element 25 assumes a position E, whereby this is kept in said position by means of a stop mechanism 30, possibly with the help of an elastic element, such as a torsion spring 31.

Figure 10:
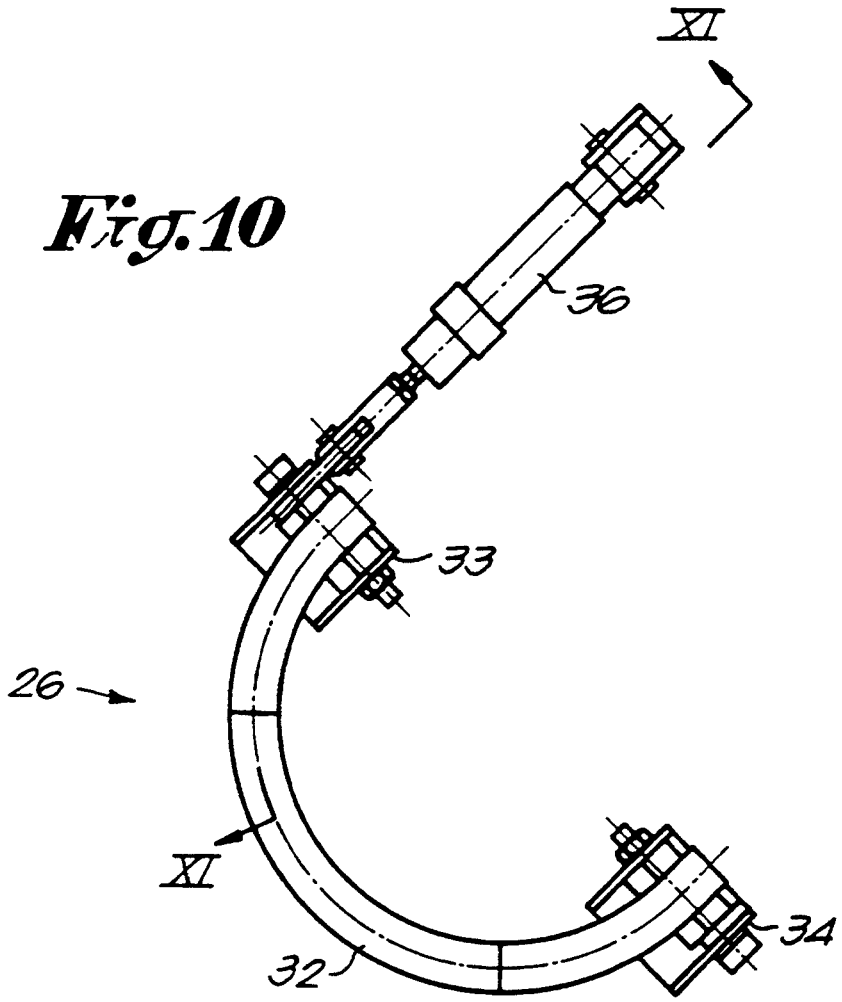
FIG. 10 shows the part indicated in FIG. 1 with F10 in greater detail.

By exerting an upward pressure force under the element 25, this may be put in a position F as represented in FIG. 8 by means of dashed line. This upward pressure force may be supplied by means of the above-mentioned control element 26, which is represented in greater detail in FIGS. 10 and 11.

In the embodiment shown, this control element 26 consists of a semi-circular guide 32 which in rest position is situated under the recess 17, more in particular under a number of the elements 25. The semi-circular guide 32 consists of a plate or such which is fixed in a hinged manner with its ends in fixed mounted supports 33 and 34 and which is connected to a control element 36 by means of a lever 35, such as a pressure cylinder, as a result of which the semi-circular guide 32 can be tilted.

As shown in FIG. 1, the semi-circular guide 32 extends at least over the quadrant where the drive element 3 and the guiding element 13 cooperate.

Figure 11:
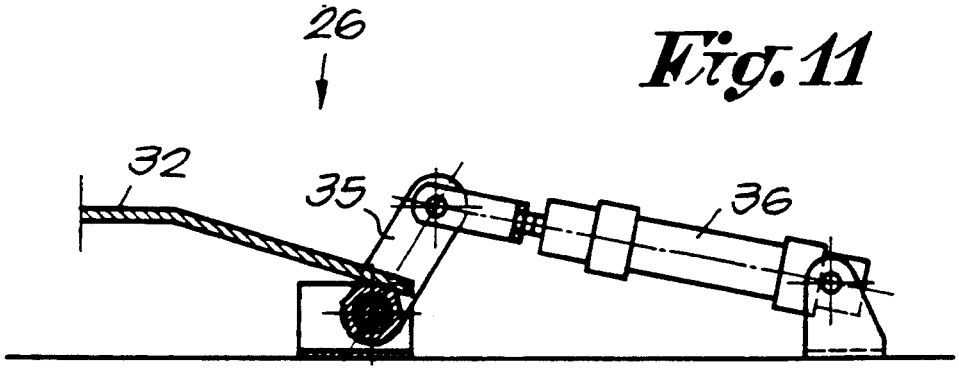
FIG. 11 represents a section according to line XI—XI in FIG. 10.

By exciting the control element 36, the guide 32 can be raised, as represented in FIG. 11, as a result of which the elements 25 rotating along the latter are locally pushed upward.

As shown in FIGS. 1 and 4, two plates 37 and 38 are provided above the guide part 13, which are each provided with a number of guides described in detail hereafter.

Figure 12:
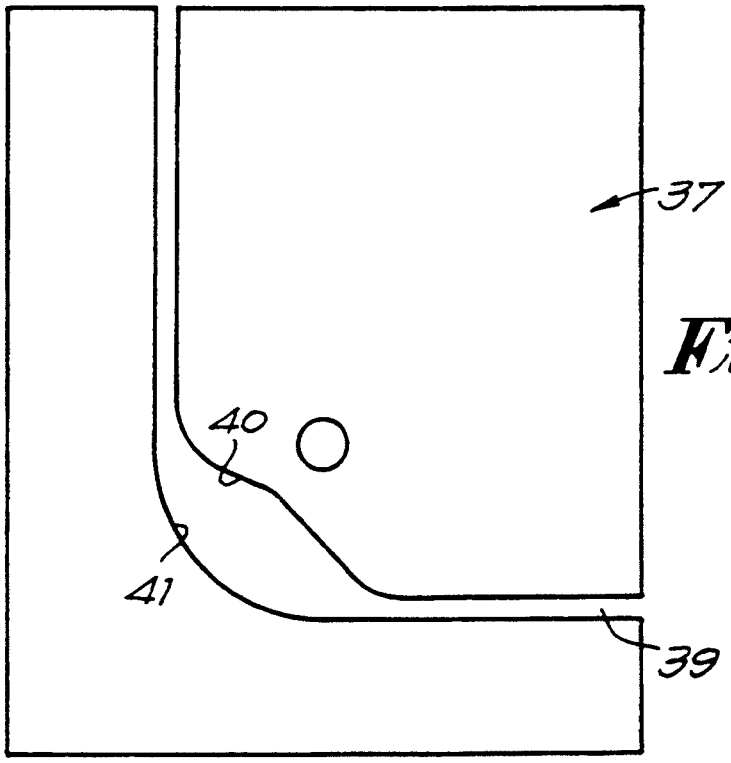
FIG. 12 represents the shape of the plate indicated in FIG. 4 by F12.

The bottom plate 37 is mounted fixed and has a shape as represented in FIG. 12. The plate 37 is provided with a recess 39, whose edges function as guides, 40 and 41 respectively. The recess 39 is in fact the continuation of the guide which is formed by the above-mentioned profiles 6 and 7. The guide 40 gradually recedes from the drive element 3 to above the recess 17 and then tapers back to the drive element 3. The guide 41 follows the outer side of the trajectory which is followed by the drive element 3.

The top plate 38 is partly fixed, but also has a disc 42 which can rotate around the above-mentioned shaft 14 in which, as represented in FIG. 1, two pairs of guides 43 and 44 are provided in the shape of recesses. In the fixed part of the plate 38 are also provided slot-shaped guides 45 and 46 which are situated on top of the drive element 3, and which form the continuation of the profiles 6 and 7.

By means of an engaging mechanism 47 described hereafter, the disc 42 may be brought in the continuation of the guide 45 either by means of the entry of a guide 43 or by means of a guide 44. Each of both above-mentioned guides 43 is bent and gradually tapers radially towards the inside, in such a manner that the end 48 thereof exactly comes out above the above-mentioned recess 17 of the guiding element 13. Each of both guides 44 consists of a recess of small dimensions which is provided in the circumference of the disc 42.

Figure 13:
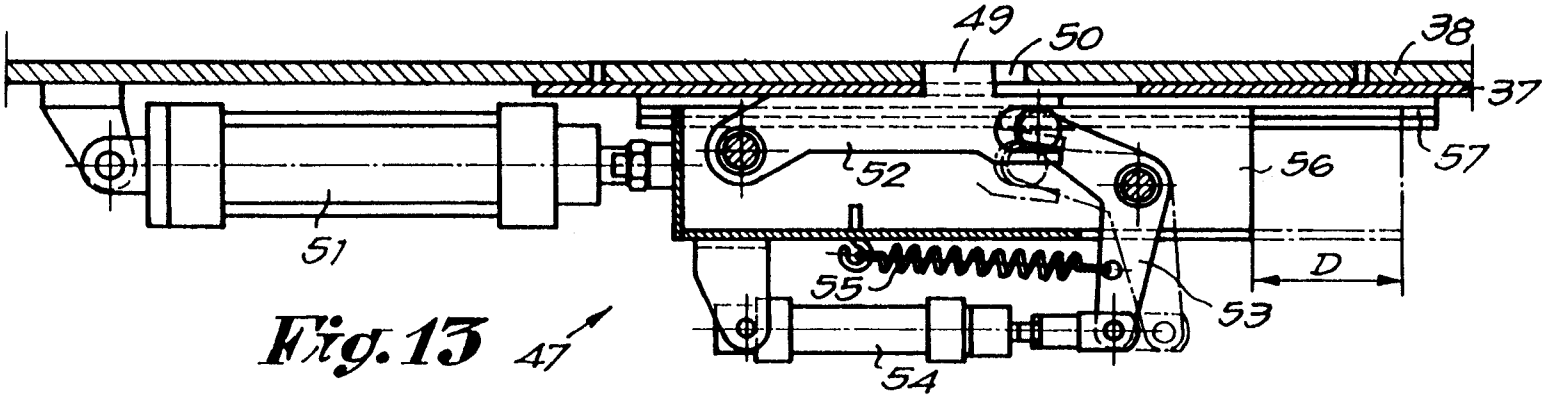
FIG. 13 shows a section to a larger scale according to line XIII—XIII in FIG. 1.

The engaging mechanism 47 is represented in detail in FIG. 13. This engaging mechanism 47 mainly consists of a pawl 49 which can work in conjunction with openings 50 in the disc 42 and which can be moved over a distance D by means of a control element 51, such as a pressure cylinder, mounted on a fixed part of for example the plate 38. The pawl 49 is part of a rotatable body 52 in such a way that the pawl 49 is put in a non-active state by means of for example a lever 53 and a control element 54 acting on it, for example also a pressure cylinder. In rest position, the pawl 49 is pressed upward, for example by means of a spring 55 which exerts a force on the lever 53, and thus can act onto an opening 50. The pawl 49, the lever 53 and the control element 54 form an interlocking mechanism for the disc 42.

The body 52, the lever 53, the control element 54 and the spring 55 are mounted on a slide 56 which can be moved as a whole by means of the control element 51 in guides 57.

The working of the device is described hereafter by means of the above-mentioned figures and the positions represented schematically in FIGS. 14 to 18.

In a state of rest, the disc 42 is in a position as represented in FIG. 1. Hereby, this disc is locked against rotation because the pawl 49 acts onto one of the openings 50. In this position, the entry of one of the guides 43 is situated in the continuation of the guide 45, which has for a result that the coupling element 4 of an approaching transport element 1 ends up in said guide 43.

Figure 14:
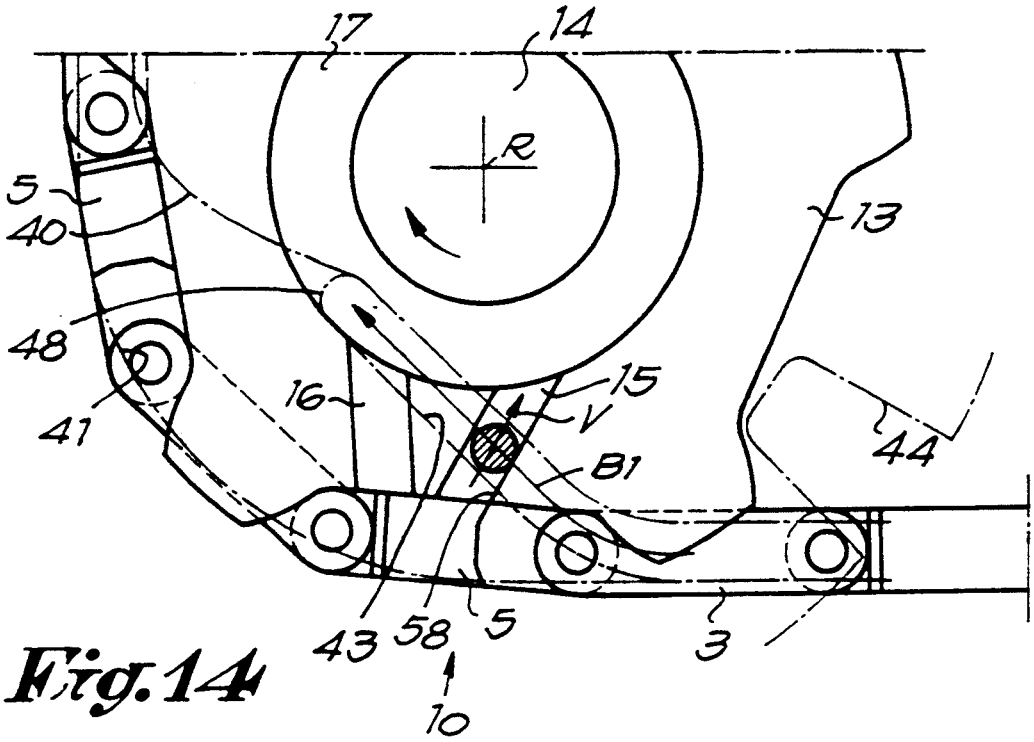
FIGS. 14 to 18 schematically illustrate the working of the device by means of different positions.

As shown in FIG. 14, this results in the coupling element being pressed sideways out of the recess 5 of the drive element 3 and being forced into the guide 15 of the rotating guiding element 13. The side 58 of the guide 15 hereby exerts a pressure force on the coupling element 4, such that this moves further in the guides 15 and 43 due to the rotating movement of the guiding element 13. The coupling element 4 hereby moves along a trajectory B1, which deviates from the above-mentioned trajectory A, such that the distance to the point of rotation R of the drive element is reduced. As the guiding element 13 turns at a constant angular speed and the above-mentioned distance is reduced, the speed of the coupling element 4 in the direction of the trajectory B1 decreases, as a result of which also the speed of the transport element 1 is reduced.

Figure 15:
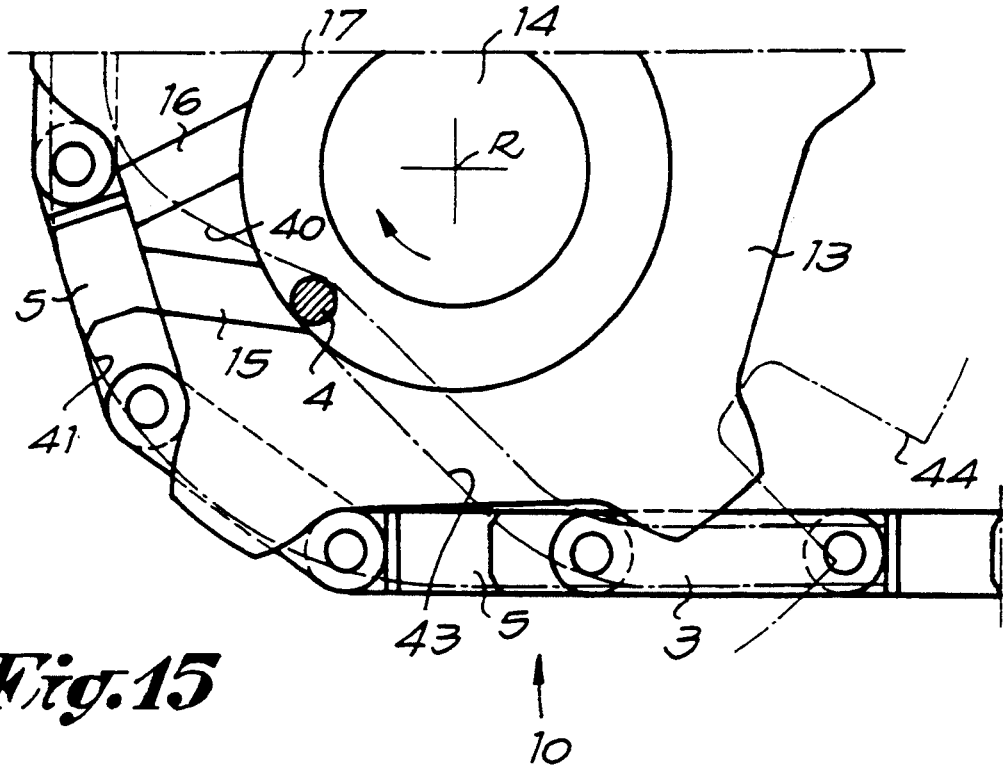

The coupling element 4 hereby shifts upward over the slanting bottom 18 of the guide 15. Finally, the coupling element 4 falls over the edge 19 into the more deeply situated circular slot-shaped recess 17, as represented in FIG. 15, with the result that no further carrier force is exerted on the coupling element 4. The transport element 1 is prevented from moving along by itself as the coupling element has reached the end 48 of the guide 43. The transport element is thus forced to a standstill after the speed thereof has been significantly reduced.

Figure 16:
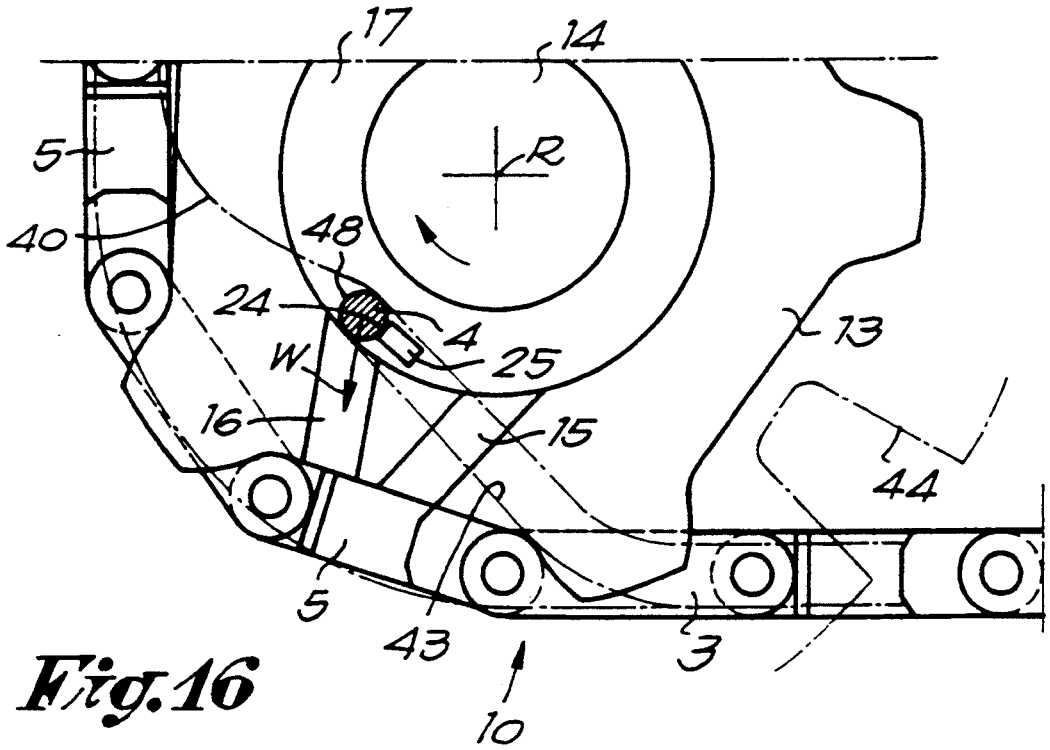
Figure 17:
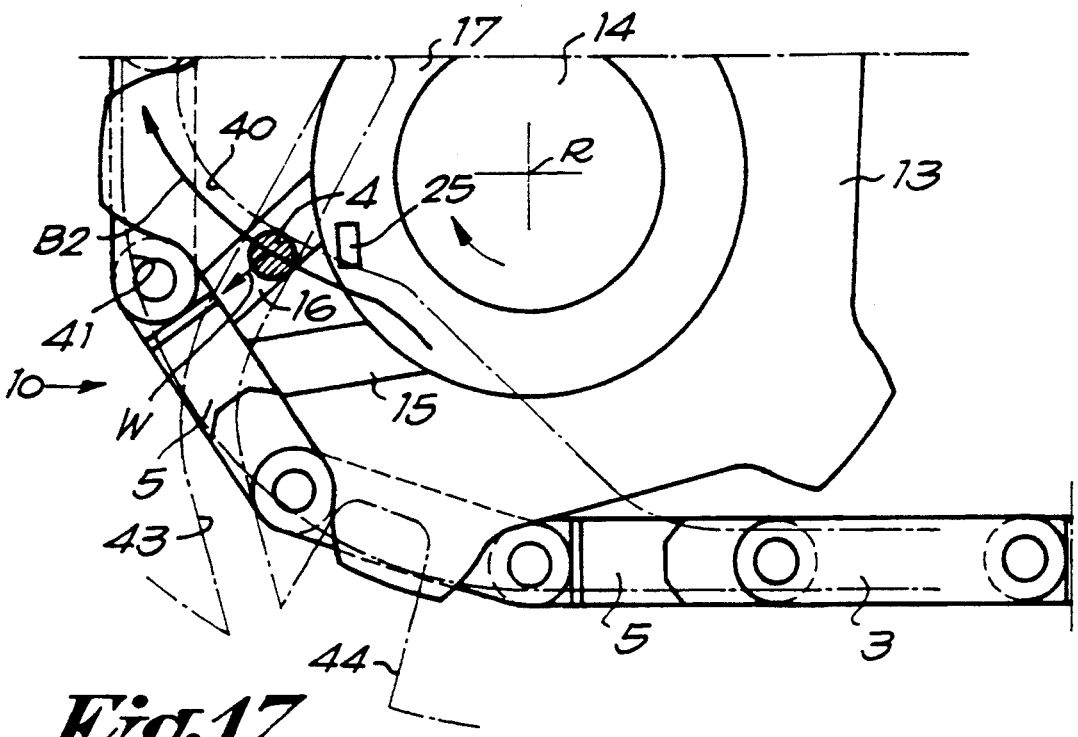

The coupling procedure is represented in FIGS. 16 and 17.

The control element 26 is hereby enforced, as a result of which the semi-circular guide 32 is erected upward in a slanting manner. The piston rod of the cylinder 36 is moved, whereby the whole assumes a position as represented in FIG. 11. The elements 25 of FIG. 8, which slide along the guide 32, are pressed upward into the guide 17 by the latter against the force of their torsion spring 31.

As a result, as represented in FIG. 16, at least one stop 24 is formed, which exerts a pressure force on the coupling element 4, as a result of which it is forced to turn along with the guiding element 13.

As represented in FIG. 17, the coupling element 4 is than radially forced outside through the guide 16 due to its contact with the guide 40. The coupling element 4 hereby shifts upward over the slanting bottom 21 to finally drop over the edge 22 in a recess 5 of the drive element 3, in this case the chain. During this movement, the coupling element 4 follows a trajectory B2, whose distance to the point of rotation R increases. Since, however, the drive element 3 has a constant speed, the absolute velocity of the coupling element 4 hereby gradually increases until it has reached the speed of the drive element 3.

In the positions represented in FIGS. 16 and 17, the disc 42 must be able to rotate freely, such that the guide forms no obstruction for the movement of the coupling element 4 according to the above-mentioned trajectory B2. Hence, as the movement B2 starts, the pawl 49 is removed from the opening 50 by commanding the control element 54 accordingly, by means of a not represented automatically controlled switch. During the movement according to the trajectory B2, the coupling element 4 exerts an indirect force on the guide 43, as a result of which the disc 42 rotates, but at a greater angular speed than the guiding element 13. The disc 42 hereby turns over 180 degrees and is than locked again by means of the pawl 49.

When the transport element must pass the device without being decoupled from the drive element 3, the entry of the recess 44 is placed in the continuation of the guide 45. This position is represented by means of a dashed line in FIG. 1. To this end the disc 42 is turned over a small angle by moving the slide 56 as mentioned above over a distance D and by subsequently removing the pawl 49 from the opening 50 such that the disc can rotate freely as of that moment.

Figure 18:
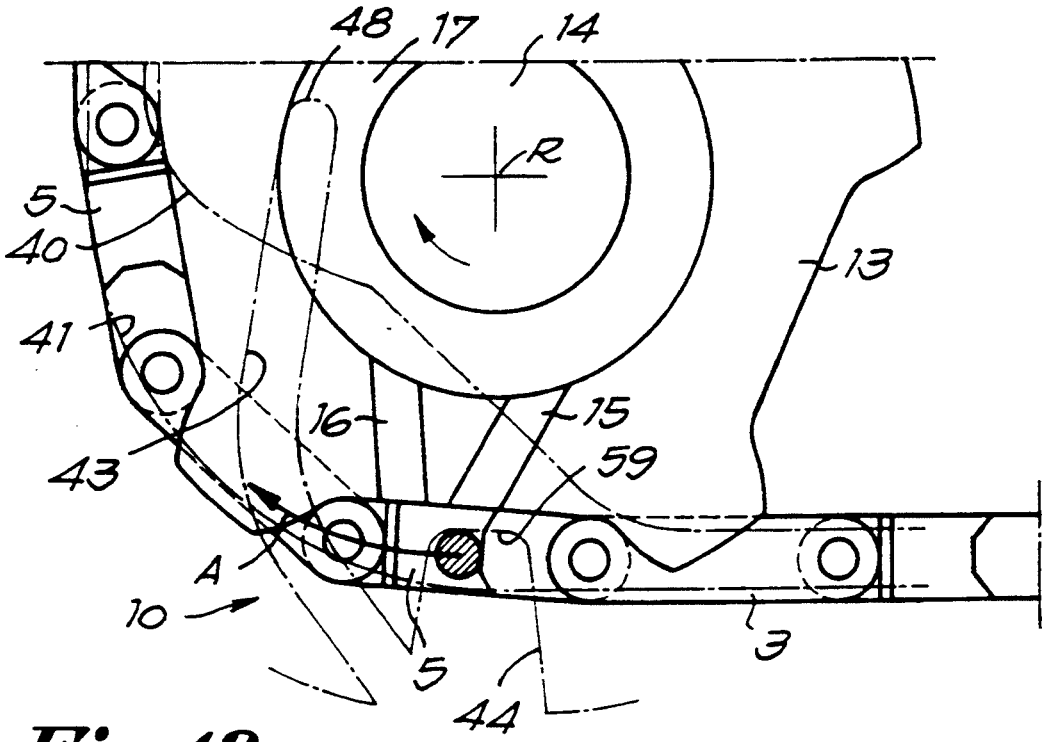

Consequently, the coupling element 4 acts onto the recess 44, as a result of which the disc is carried along with the movement of the coupling element 4. Since the coupling element 4 is caught between the inner wall 59 of the recess 44 and the guide 41, as represented in FIG. 18, it is forced to follow the trajectory A of the chain.

The present invention is in no way limited to the embodiment described by way of example and shown in the accompanying drawings; on the contrary, such a method and device for the decoupling and/or coupling of transport elements can be made in various forms and dimensions while still remaining within the scope of the invention.

I claim:

1. A device for coupling and decoupling transport elements with a continuously moving drive element, said transport elements having coupling elements cooperating with said moving drive element, comprising:

means for coupling and decoupling being configured to gradually reduce the speed of one of said coupling elements prior to a decoupling and to gradually increase the speed of one of said coupling elements after a coupling, said means for coupling and decoupling including:

(A) a rotating guiding element provided with a substantially circular recess, and a plurality of coupling element guides extending outward from said circular recess, and each said guide positioned oblique to a radial direction of the guiding element; and (B) a semi-circular guide positioned under the circular recess for selectively controlling one of said coupling elements.

2. The device according to claim 1, wherein the substantially circular recess is ring-shaped.

3. The device according to claim 2 wherein at least one of the coupling elements guides is mainly radially tapered to exert a carrier force on the coupling element during the decoupling.

4. The device according to claim 3, wherein the above-mentioned at least one coupling element guide has a slanting bottom which tapers radially upward towards an inside, with an inner edge thereof situated higher than a bottom of the ring-shaped recess.

5. The device according to claim 2, wherein at least one of the coupling element guides is radially tapered to exert a carrier force on the coupling element during the coupling.

6. The device according to claim 5, wherein the at least one coupling element guide has a slanting bottom which tapers radially upward towards an outside, with an outer edge thereof situated higher than a bottom of a recess in the drive element.

7. The device according to claim 1 wherein the rotating guiding element comprises a gear wheel turned by a movement of the continuously moving drive element.

8. The device according to claim 1 wherein the rotating guiding element comprises a plate with a guide recess, the guide recess having a first guide edge to force the coupling element towards the drive element during the coupling, and a second guide edge to lead the coupling element in case the transport element would have to pass without being decoupled.

9. The device according to claim 1 further comprising an engaging mechanism operable to decouple the transport element and to keep the transport element coupled to the drive element.

10. The device according to claim 9, wherein the engaging mechanism comprises a rotatable disc with at least one first guide to force the coupling element in decoupled position, and at least one second guide to force the coupling element to follow a trajectory of the drive element, whereby the coupling element follows one of the first and second guides due to the rotation of the rotatable disc.

11.The device according to claim 10, wherein the disc includes at least one opening formed therein, and an interlocking mechanism with a disconnectable pawl operable to work in conjunction with the at least one opening in the disc.

12. The device according to claim 1, further comprising a control element means for controlling the semicircular guide.

13. The device according to claim 1, wherein the coupling element guides extend outward in alternating slanting directions.

14. The device according to claim 1, further comprising said drive element including an endless element provided with recesses, and said coupling elements including vertical pins cooperating with said recesses.

* * * * *